US011796270B2

(12) United States Patent
Elftmann, Jr.

(10) Patent No.: US 11,796,270 B2
(45) Date of Patent: Oct. 24, 2023

(54) TRIGGER PULL FORCE ADJUSTMENT SYSTEMS AND METHODS

(71) Applicant: Arthur J. Elftmann, Jr., Glendale, AZ (US)

(72) Inventor: Arthur J. Elftmann, Jr., Glendale, AZ (US)

( * ) Notice: Subject to any disclaimer, the term of this patent is extended or adjusted under 35 U.S.C. 154(b) by 0 days.

(21) Appl. No.: 17/947,953

(22) Filed: Sep. 19, 2022

(65) Prior Publication Data

US 2023/0088105 A1 Mar. 23, 2023

Related U.S. Application Data

(60) Provisional application No. 63/246,646, filed on Sep. 21, 2021.

(51) Int. Cl.
*F41A 19/16* (2006.01)

(52) U.S. Cl.
CPC ..... *F41A 19/16* (2013.01)

(58) Field of Classification Search
CPC ..... F41A 19/16; F41A 19/17; F41A 19/10
USPC ..... 42/69.03
See application file for complete search history.

(56) References Cited

U.S. PATENT DOCUMENTS

| | | | | |
|---|---|---|---|---|
| 6,131,324 | A * | 10/2000 | Jewell | F41A 19/16 89/139 |
| 6,880,281 | B1 * | 4/2005 | Orr | F41A 17/46 42/69.01 |
| 7,047,685 | B2 * | 5/2006 | Diaz | F41A 19/16 42/69.02 |
| 9,170,063 | B2 * | 10/2015 | Krieger | F41A 19/10 |
| 11,015,894 | B1 * | 5/2021 | Malina | F41A 19/16 |
| 11,162,752 | B2 * | 11/2021 | Elftmann, Jr. | F41A 19/16 |

* cited by examiner

*Primary Examiner* — Reginald S Tillman, Jr.
(74) *Attorney, Agent, or Firm* — The Law Offices of Lisa & Lesko, LLC; Justin J. Lesko, Esq.

(57) ABSTRACT

A screw and spring assembly for adjusting trigger pull force comprises (1) a trigger housing, (2) a trigger shoe that is inside of the trigger housing (typically sitting on a bushing that runs through the housing and the trigger shoe) (3) a spacer, (4) a trigger-shoe compression spring, (5) an adjustable screw, and (6) a pressed-fitted compression spring that "locks" the adjustable screw into place in various positions, wherein the pull force needed to pull the trigger is different at each of the various positions.

20 Claims, 20 Drawing Sheets

TRIGGER PULL FORCE ADJUSTMENT SYSTEMS AND METHODS

CROSS REFERENCE TO RELATED APPLICATIONS

This application claims the benefit of Provisional Application No. 63/246,646 filed on Sep. 21, 2021, which is hereby incorporated by reference in its entirety

BACKGROUND OF THE INVENTION

Field of the Invention

This is a screw and spring assembly for adjusting the amount of pressure on a trigger shoe in a weapon, wherein the adjustments increase or decrease the amount of pull force on the trigger necessary to release a hammer and fire the weapon. Some key features of the assembly are (1) a spring keeps a minimum amount of tension on the trigger shoe at all times, even if the screw is removed from the assembly, (2) the pressure can be adjusted by hand-tightening the screw or by using a screwdriver to tighten the screw, (3) the assembly provides an upper limit on how far the screw can be tightened which correspondingly limits the amount of pressure on the trigger shoe and (4) a second spring is used to "click" the screw into place every half turn, which also prevents the assembly from slipping (thereby maintaining the pressure as selected) when the weapon is fired.

Description of Known Art

The screw and spring assembly described herein is configured to work with existing triggers. Allowed application Ser. No. 16/788,270 (incorporated by reference herein) describes one trigger that is compatible with the screw and spring assembly described herein: "A trigger assembly for use in a weapon, the trigger assembly comprising: a disconnector having (1) a catch edge that is configured to be urged by a spring to a position that restrains a hammer from rotation until the trigger is pulled and (2) a projection that interconnects the disconnector to a trigger shoe, the projection comprising (i) a neck and (ii) a head; the trigger shoe having a slot for receiving the projection, wherein the head fits into the slot and the slot includes a gap configured to enable movement of the neck such that the trigger, when pulled, will urge the catch edge away from the hammer against the spring's force thereby releasing the hammer to fire the weapon." The screw and spring assembly described herein can be added to the above-described trigger and used to adjust the amount of force necessary to urge the catch edge away from the hammer. The screw and spring assembly described herein can also be applied to other existing triggers (including drop-in triggers) to adjust the pull force necessary to fire those triggers too.

Applicant believes that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), applicants will amend the specification to expressly recite the essential material that is incorporated by reference as allowed by the applicable rules.

SUMMARY OF THE INVENTION

A screw and spring assembly for adjusting trigger pull force comprises (1) a trigger housing, (2) a trigger shoe that is inside of the trigger housing (typically sitting on a bushing that runs through the housing and the trigger shoe) (3) a spacer, (4) a trigger-shoe compression spring, (5) an adjustable screw, and (6) a pressed-fitted compression spring that "locks" the adjustable screw into place in various positions, wherein the pull force needed to pull the trigger is different at each of the various positions.

Objects and advantages pertaining to the screw and spring assembly may become apparent upon referring to the example embodiments illustrated in the drawings and disclosed in the following written description or appended claims.

This summary is provided to introduce a selection of concepts in a simplified form that are further described below in the Detailed Description. This Summary is not intended to identify key features or essential features of the claimed subject matter.

Aspects and applications of the invention presented here are described below in the drawings and detailed description of the invention.

BRIEF DESCRIPTION OF THE DRAWINGS

A more complete understanding of the present invention may be derived by referring to the detailed description when considered in connection with the following illustrative figures. In the figures, like reference numbers refer to like elements or acts throughout the figures.

FIG. 21 is the trigger shoe 34 and bushing.

Figure 1:
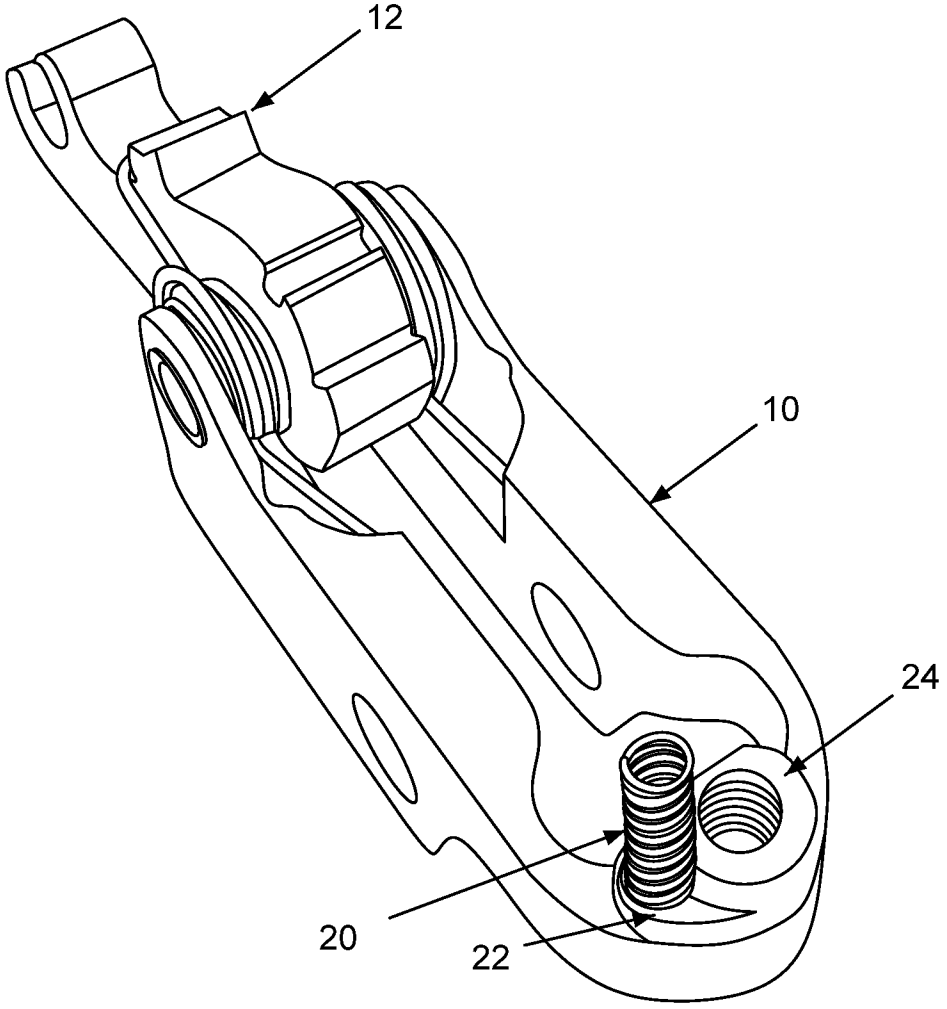
FIG. 1 is a top view of the trigger housing 10 after the compression spring 20 has been press-fitted into place—the hammer 12 is opened to provide a view of the components.
Figure 2:
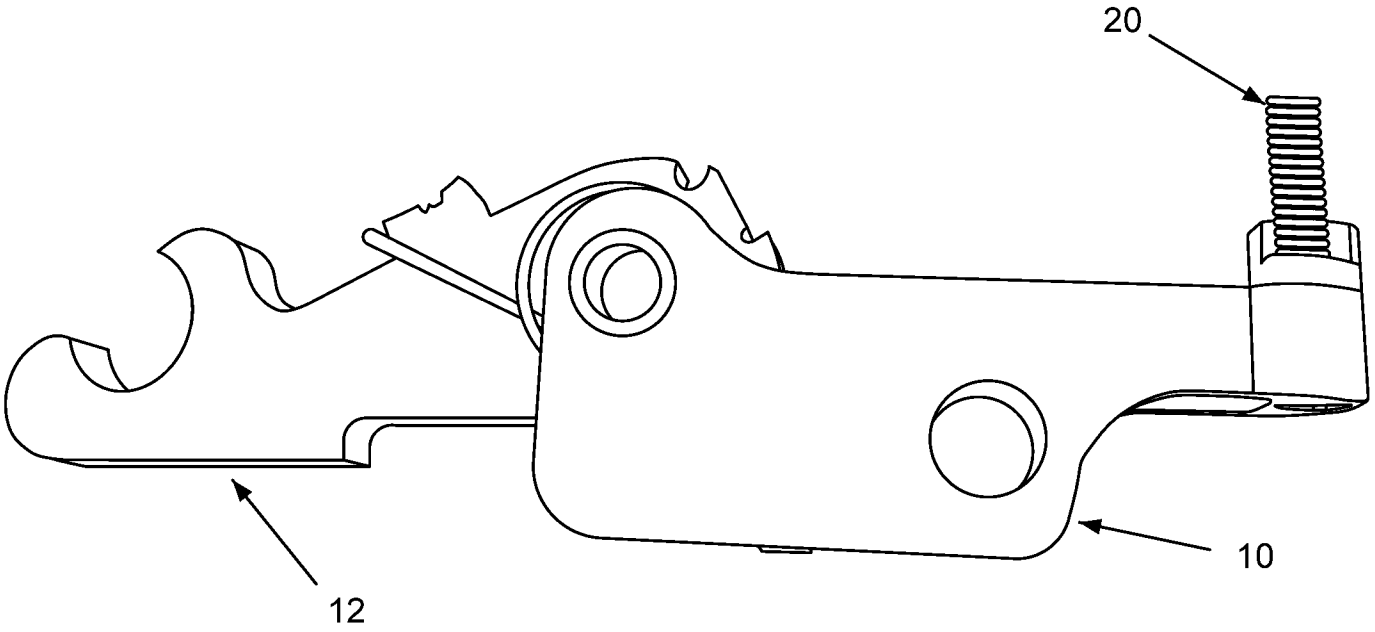
FIG. 2 is a side view of the trigger housing 10 after the compression spring 20 has been press-fitted into place.
Figure 3:
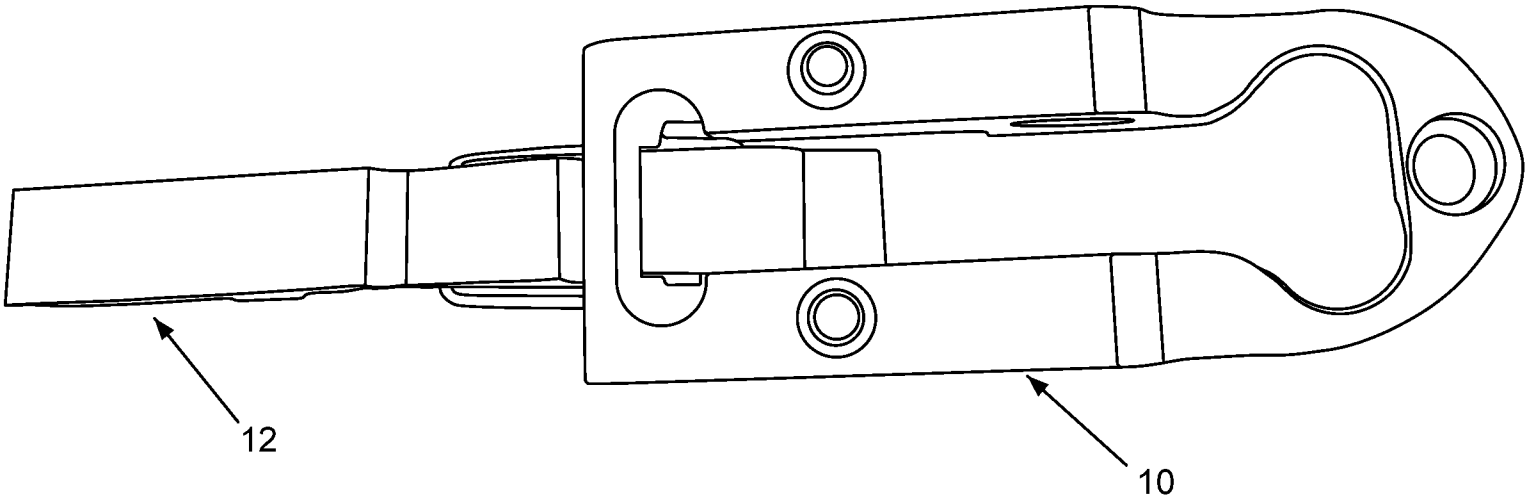
FIG. 3 is a bottom view of the trigger housing 10.
Figure 4:
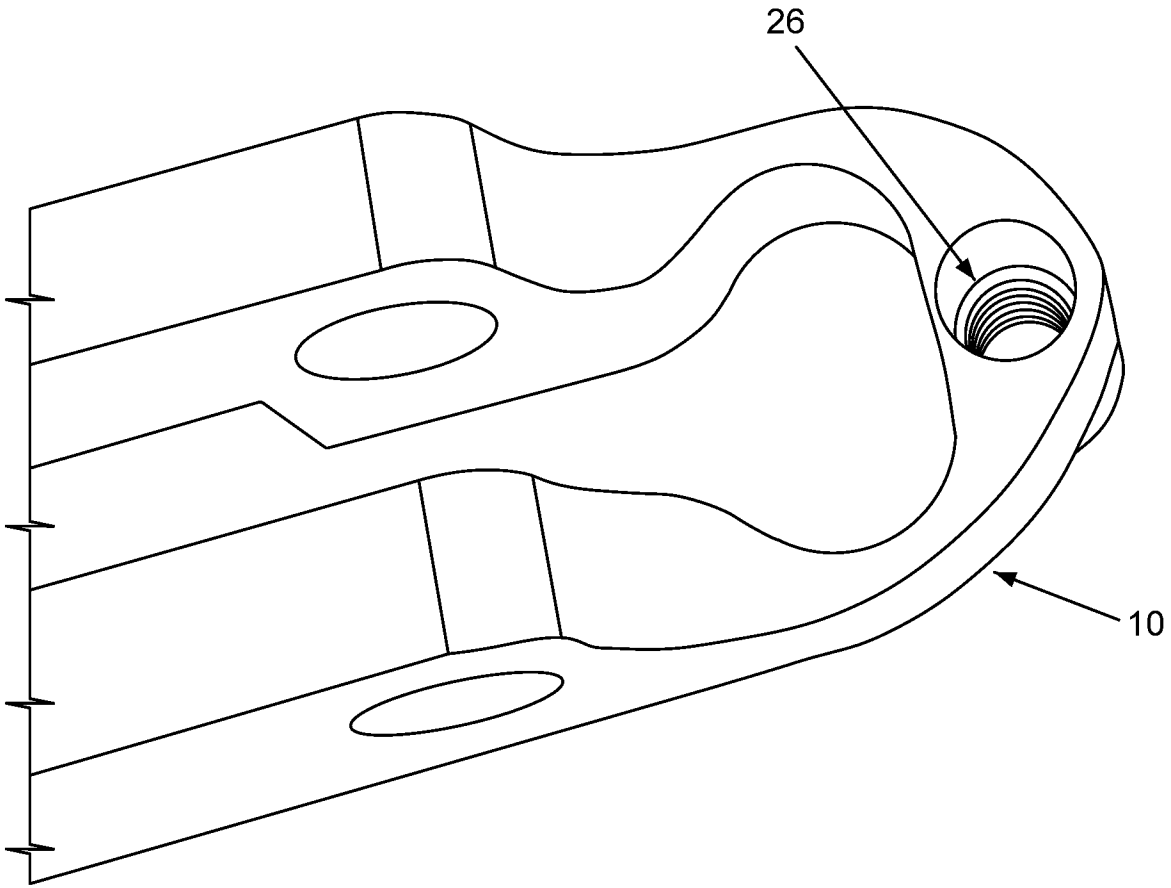
FIG. 4 is a bottom view of the trigger housing 10 showing the shelf 26.
Figure 5:
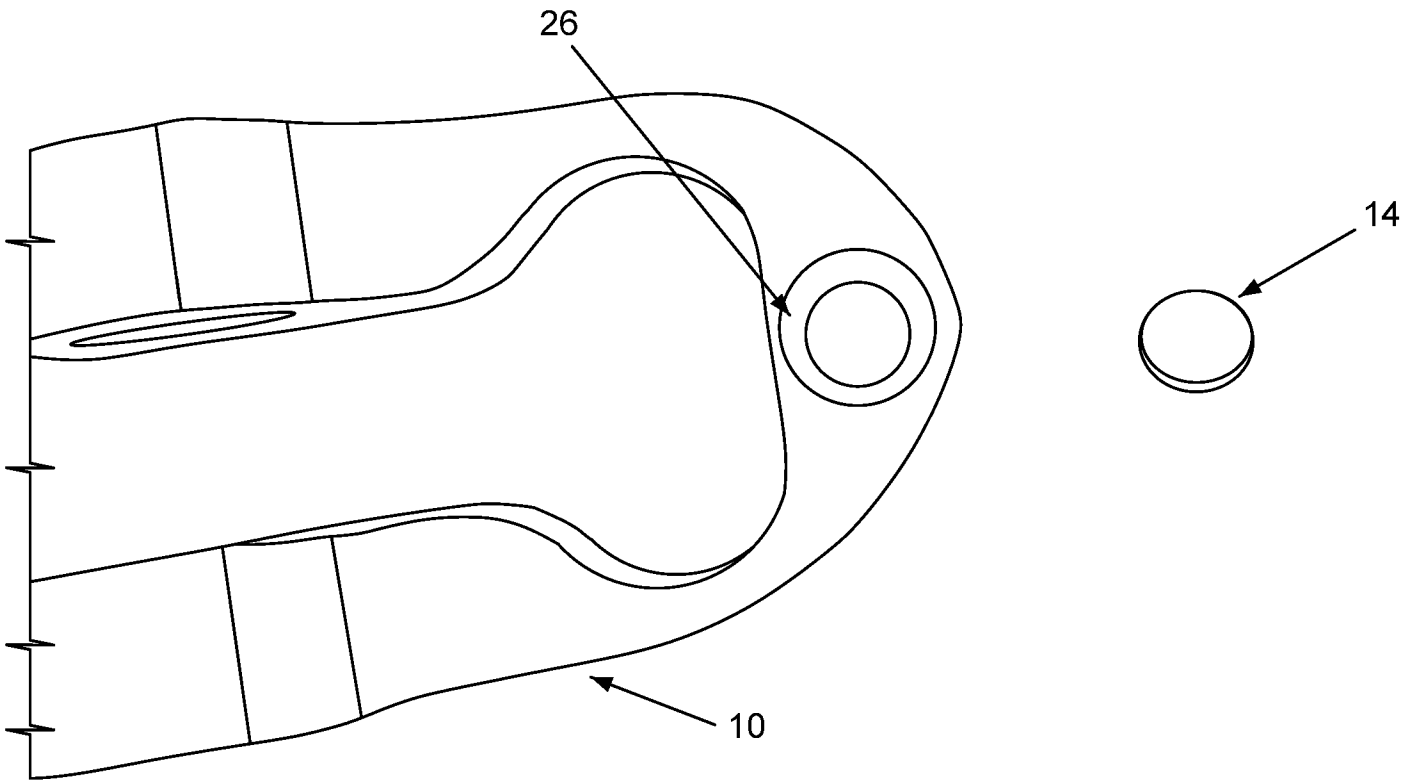
FIG. 5 is a partial bottom view of the trigger housing 10 showing the shelf 26. The spacer 14 is next to the trigger housing.
Figure 6:
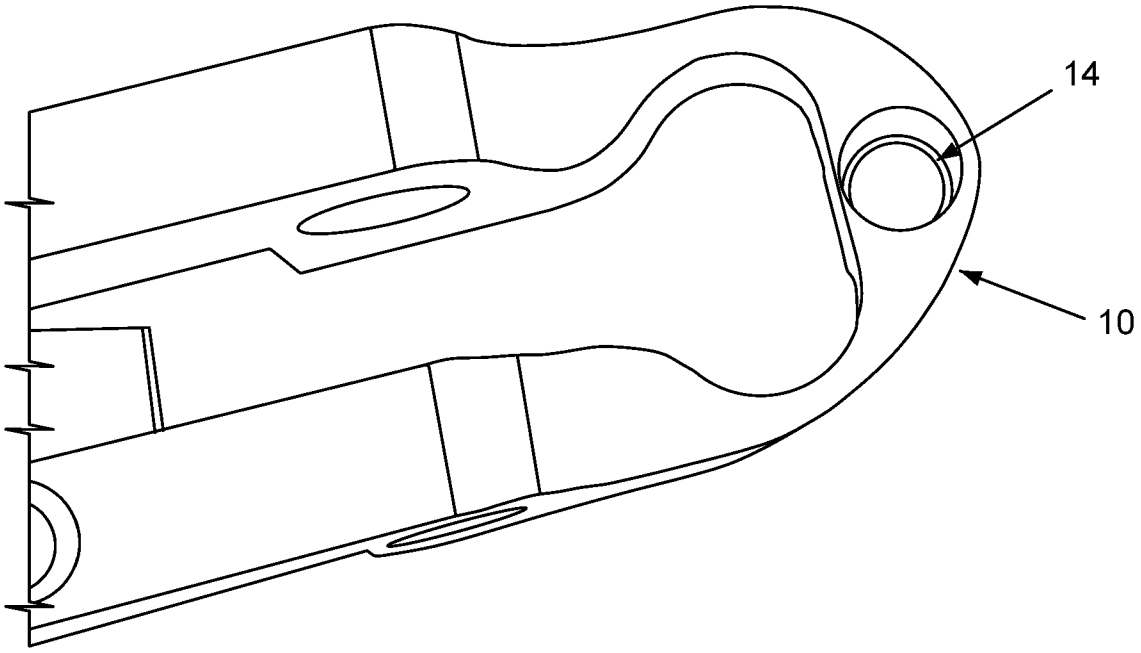
FIG. 6 is a partial bottom views of the trigger housing 10 showing the spacer 14 resting on the shelf 26.
Figure 7:
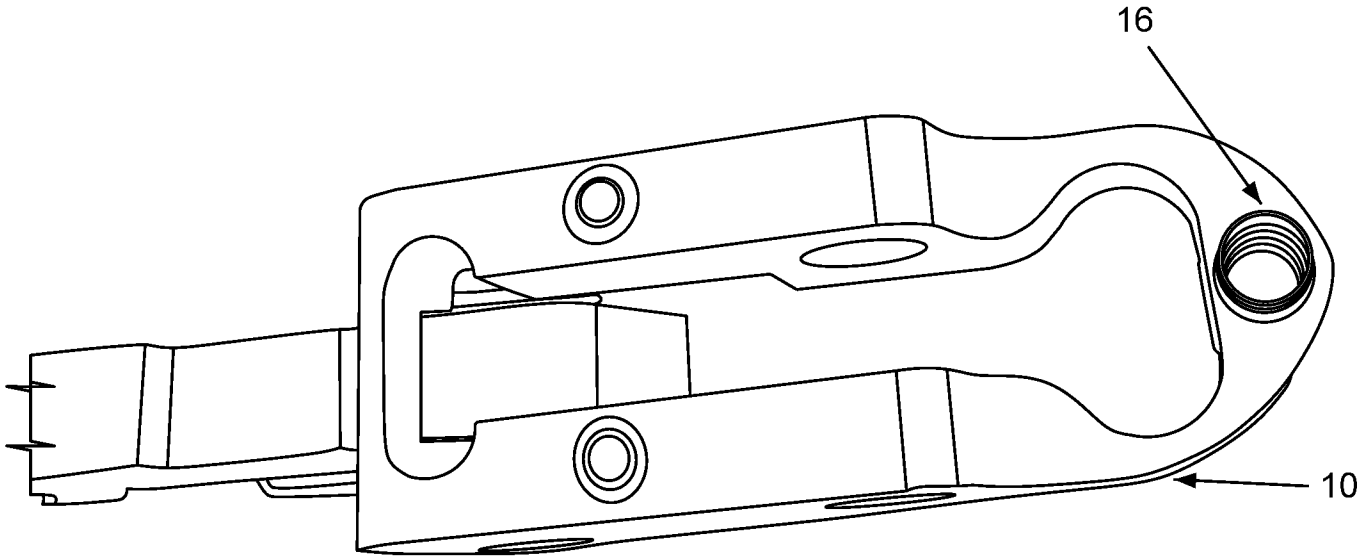
FIG. 7 is a partial bottom view of the trigger housing 10 showing the trigger-shoe compression spring 16 resting on the spacer 14.
Figure 8:
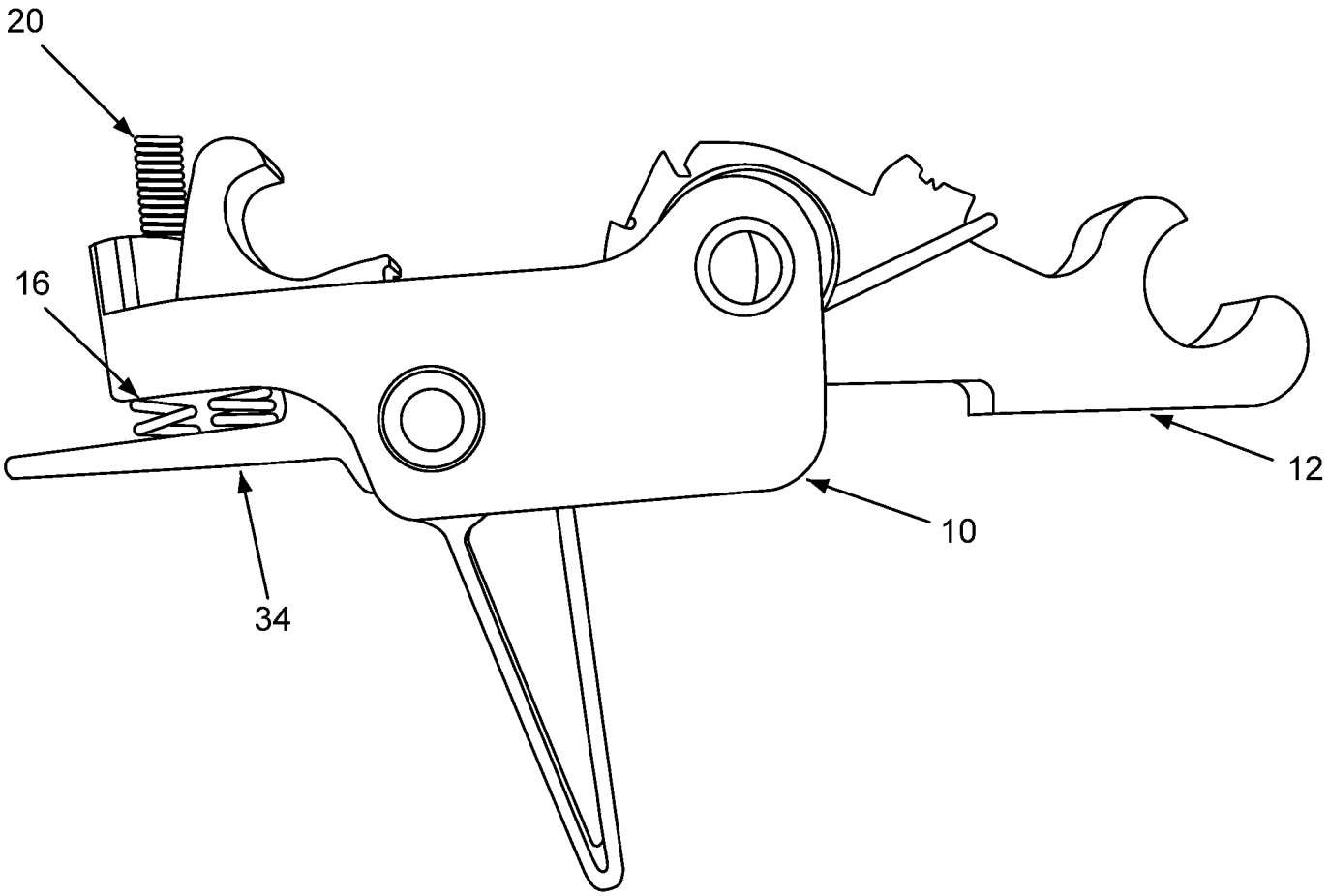
FIG. 8 is a side view of the trigger assembly including the trigger housing 10, the trigger-shoe 34, the compression spring 20, and the compression spring 16 that pushes against the trigger-shoe 34 and the spacer 14 (not shown) inside of the bore 24.
Figure 9:
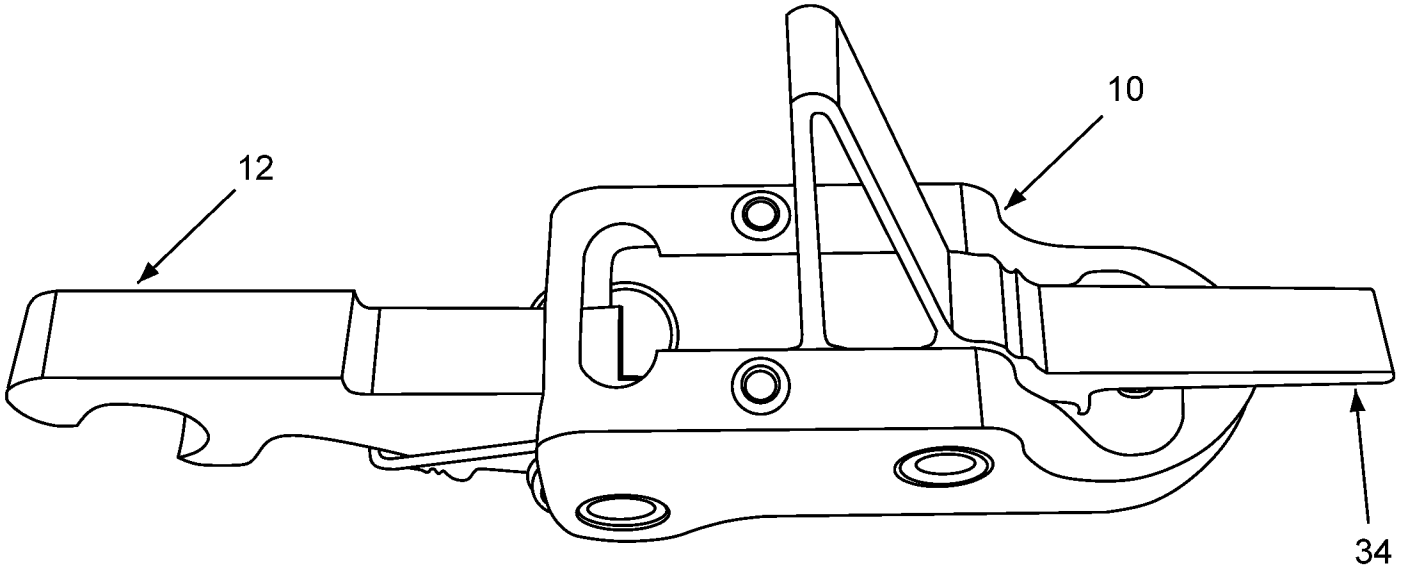
FIG. 9 is a bottom isometric view of the arrangement shown in FIG. 8.
Figure 11:
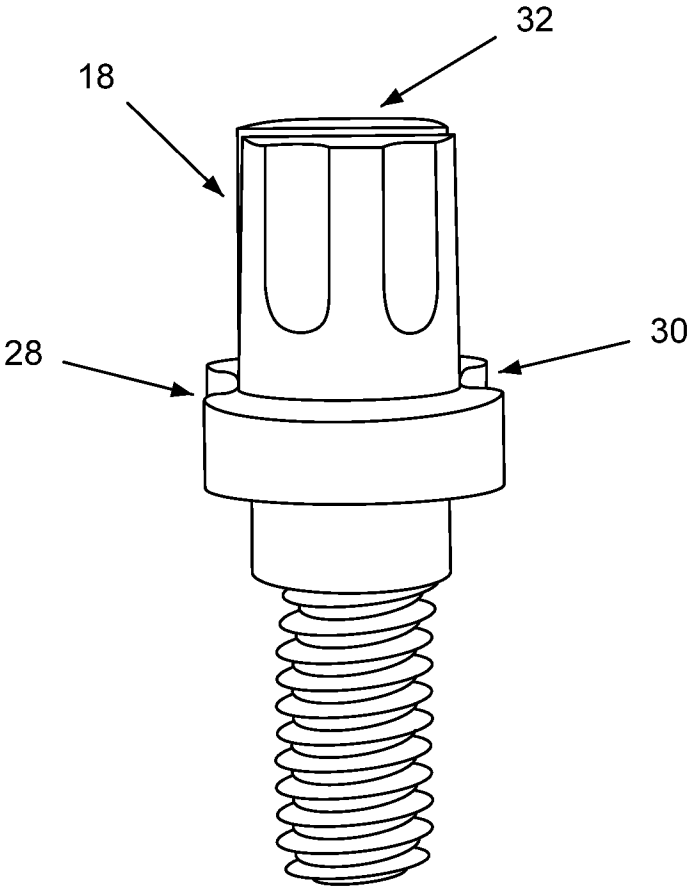
FIGS. 10 and 11 are side views of the adjustable screw 18.
Figure 10:
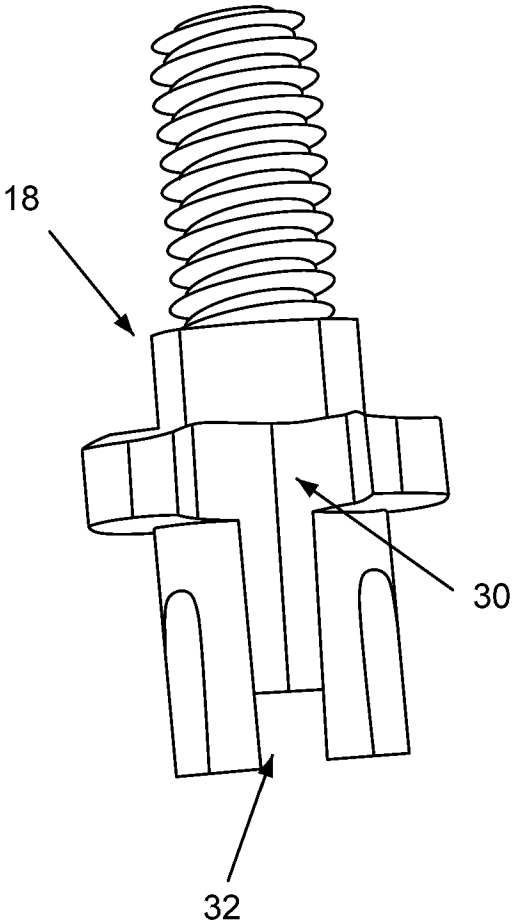
Figure 13:
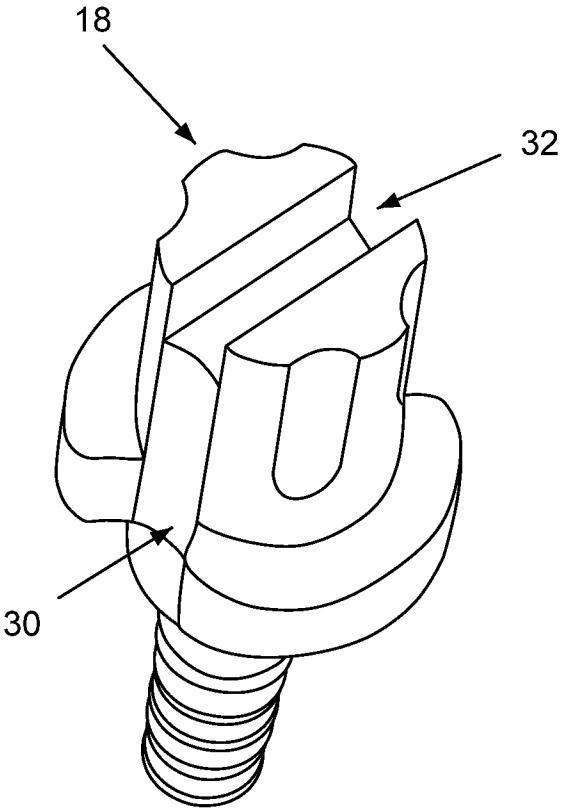
FIG. 13 is an isometric view of the adjustable screw 18.
Figure 12:
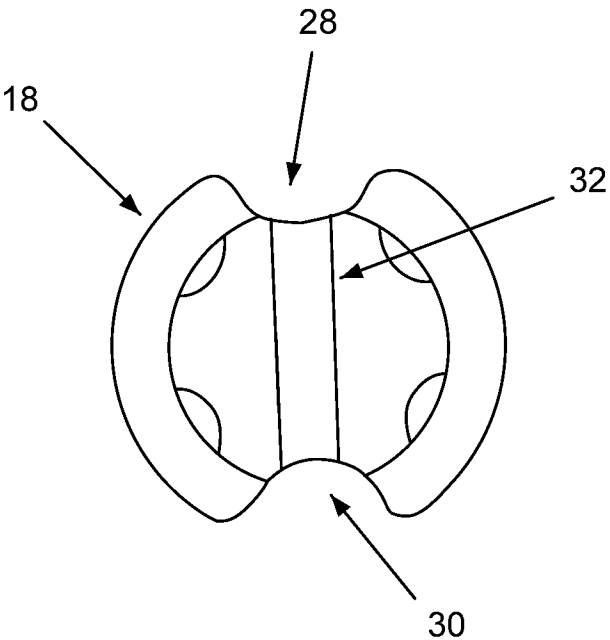
FIG. 12 is a top view of the adjustable screw 18.

Elements and acts in the figures are illustrated for simplicity and have not necessarily been rendered according to any particular sequence or embodiment.

Embodiments depicted are shown only schematically, and not all features may be shown in full detail or in proper proportion. Certain features or structures may be exaggerated relative to others for clarity. The embodiments shown are examples only, and should not be construed as limiting the scope of the present disclosure or appended claims

DETAILED DESCRIPTION OF SELECTED EMBODIMENTS

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the invention is not limited to the examples that are described below.

The example shown in the figures comprises (inter *alia*) the following elements: (1) a trigger housing 10, (2) a trigger shoe 34 that is inside of the trigger housing (typically sitting on a bushing that runs through the housing and the trigger shoe) (3) a spacer 14, (4) a trigger-shoe compression spring 16, (5) an adjustable screw 18, and (6) a pressed-fitted compression spring 20 that "locks" the adjustable screw 18 into place.

In the example shown in the figures, the trigger shoe 34 includes a disconnector having (1) a catch edge that is configured to be urged by a spring to a position that restrains a hammer 12 from rotation until the trigger is pulled and (2) a projection that interconnects the disconnector to a trigger shoe, the projection comprising (i) a neck and (ii) a head; the trigger shoe having a slot for receiving the projection, wherein the head fits into the slot and the slot includes a gap configured to enable movement of the neck such that the trigger, when pulled, will urge the catch edge away from the hammer 12 against the spring's force thereby releasing the hammer 12 to fire the weapon.

In the example shown in the figures, the trigger housing 10 has includes a bore 22 on its top side for receiving the pressed-fitted compression spring 20 that "locks" the adjustable screw 18 into place. The trigger housing 10 also has a threaded bore 24 on its top side for receiving the adjustable screw 18. The threads in the threaded bore 24 do not extend through the entire depth of the trigger housing 10. In the example shown in the figures, the threads extend about half-way toward the bottom of side of the trigger housing 10, although the threads can extend more or less in alternative embodiments. On the bottom side of the trigger housing 22, the bore 24 is slightly wider and extends to where the threads of the bore end. The slightly wider bore creates a "shelf" 26 for the spacer 14. When assembled, the spacer 14 rests on top of shelf 26. When assembled, the adjustable screw 18 is in contact with one side of the spacer and the trigger-shoe compression spring 16 is in contact with the other side of the spacer. Also, because the trigger-shoe compression spring 16 is in contact with the spacer 14 which is restrained by the shelf 16, the spacer 14 and the trigger-shoe compression spring 16 stay in place even if the adjustable screw 18 is removed from the assembly. This ensures that some minimum level of tension is always placed on the trigger shoe 34 by the compression spring 16, and it also prevents the compression spring 16 from falling out of the assembly when the adjustable screw 18 is removed. The amount of tension exerted by the spring compression spring 16 (both the minimum and maximum tension) on the trigger shoe 34 depends on the thickness of the compression spring 16—using thicker springs will increase that tension and using thinner springs will decrease that tension.

In the example shown in the figures, the spacer 14 is a separate piece that rests on the shelf—however it can instead be glued or welded to the spring 16 or part of the spring 16. In some embodiments without a spacer, the screw 18 can be in direct contact with the spring 16.

Figure 14:
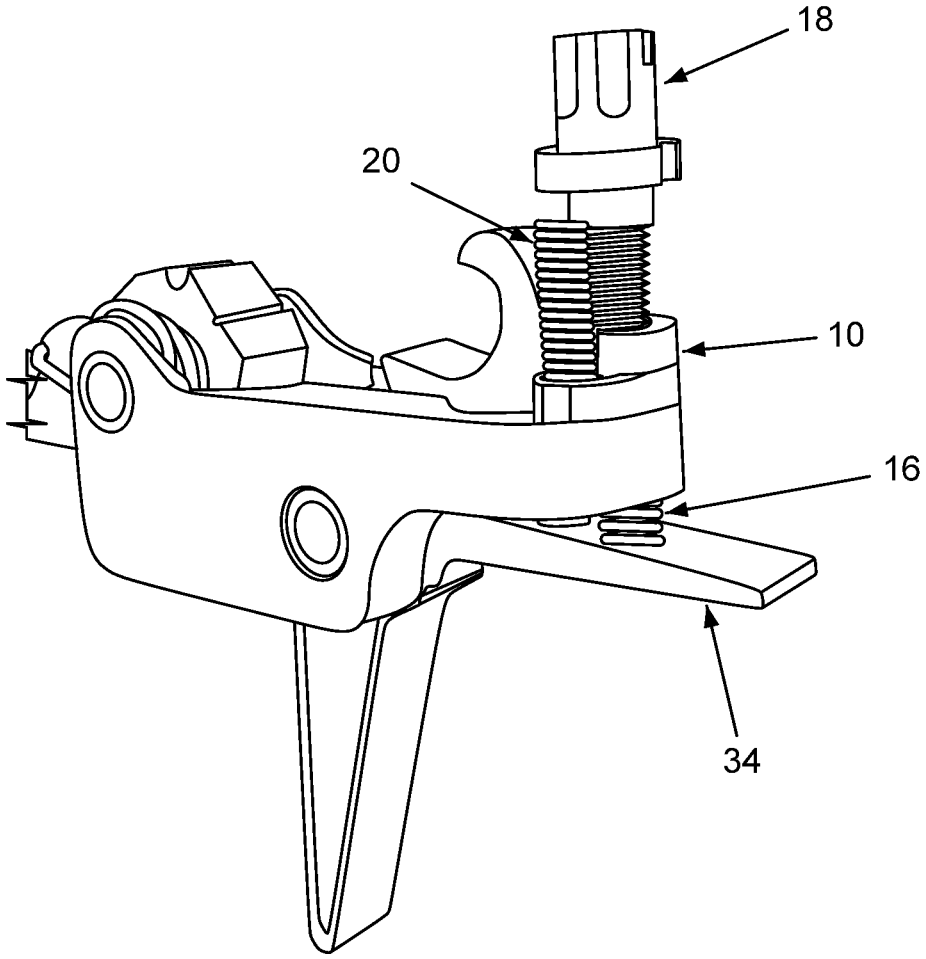
FIG. 14 is an isometric view of the trigger assembly including the trigger housing 10, the trigger-shoe 34, the compression spring 20, the compression spring 16 that pushes against the trigger-shoe 34 and the spacer 14 (not shown) inside of the bore 24, and the adjustable screw 18.
Figure 15:
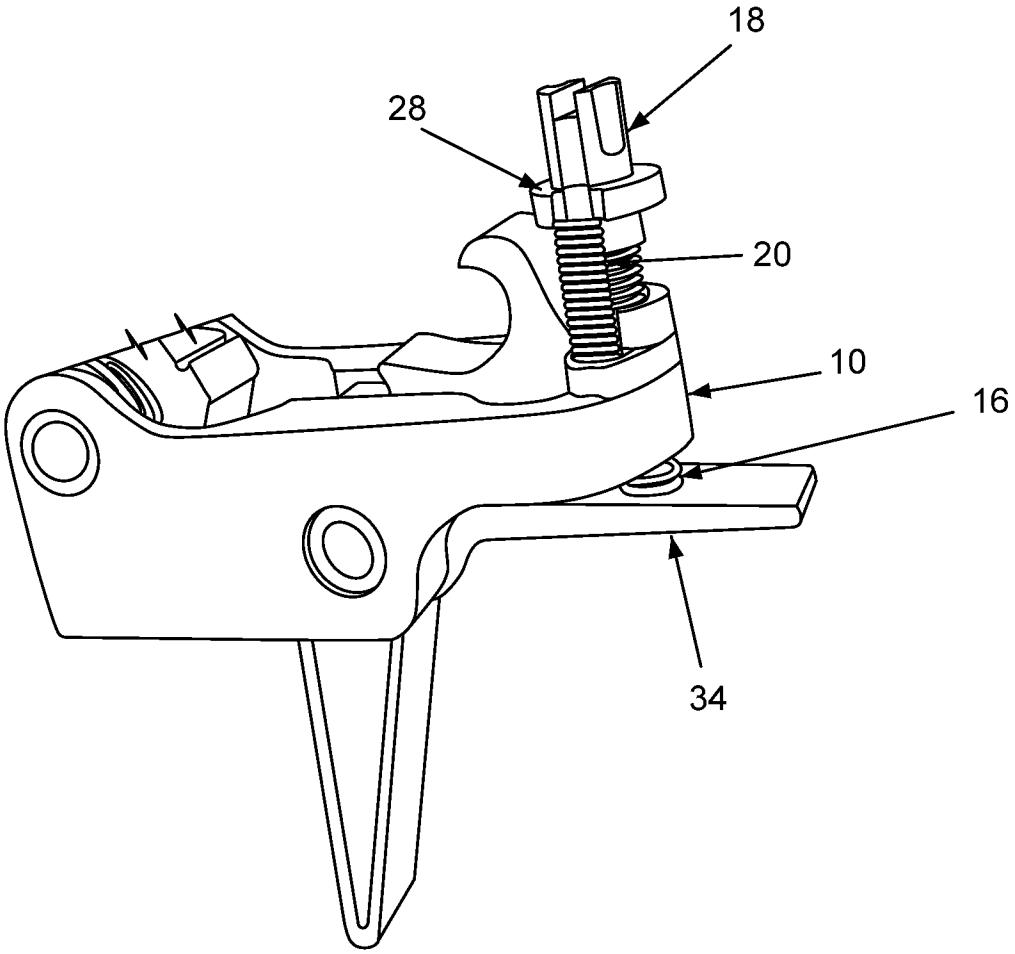
FIG. 15 is an isometric view of the trigger assembly including the trigger housing 10, the trigger-shoe 34, the compression spring 20, the compression spring 16 that pushes against the trigger-shoe 34 and the spacer 14 (not shown) inside of the bore 24, and the adjustable screw 18. The compression spring 20 is clicked into place to "lock" the adjustable screw 18.
Figure 16:
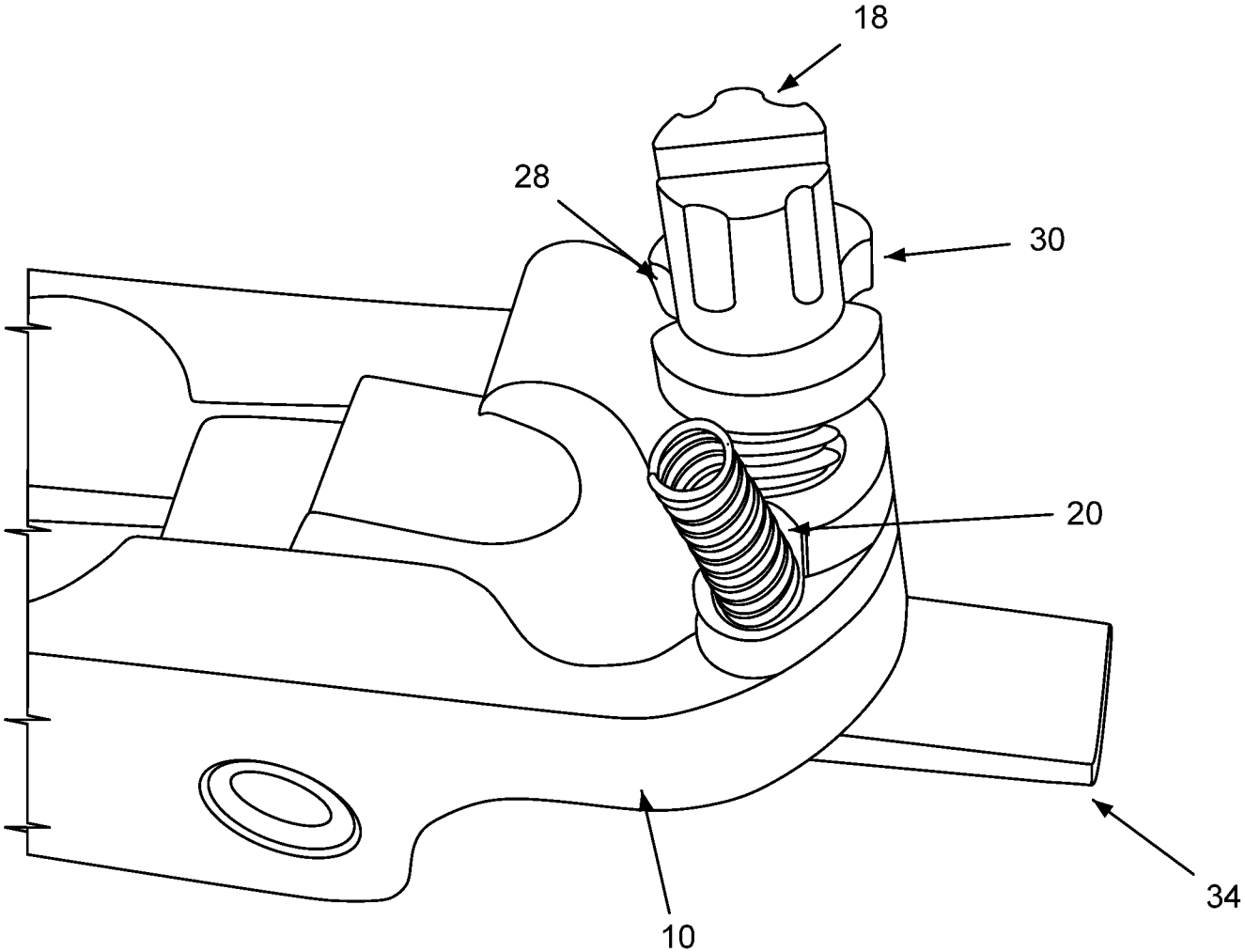
FIG. 16 is an isometric view of the trigger assembly including the trigger housing 10, the trigger-shoe 34, the compression spring 20, the compression spring 16 that pushes against the trigger-shoe 34 and the spacer 14 (not shown) inside of the bore 24, and the adjustable screw 18. The compression spring 20 is not clicked into place to "lock" the adjustable screw 18.
Figure 17:
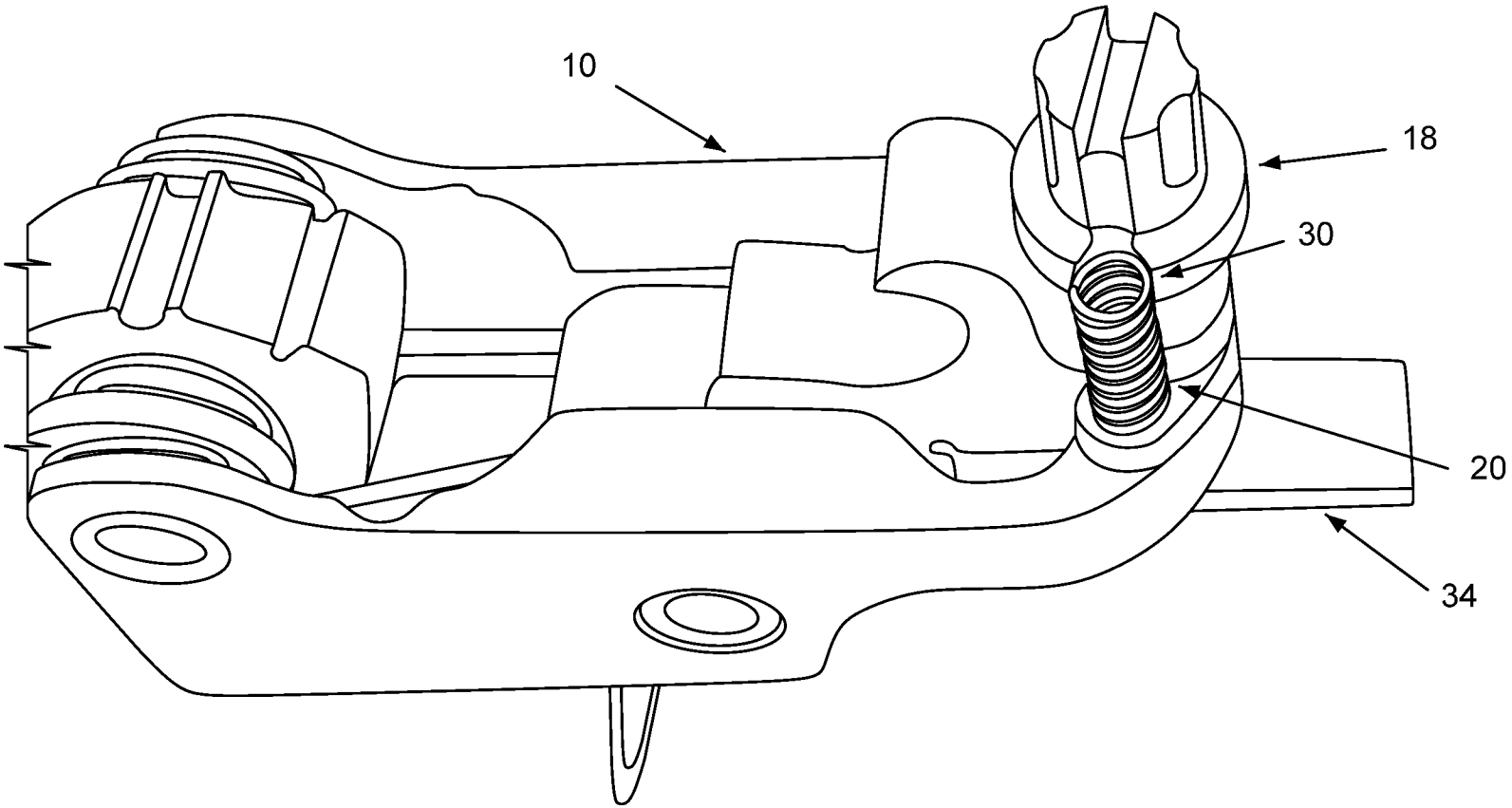
FIG. 17 is an isometric view of the trigger assembly including the trigger housing 10, the trigger-shoe 34, the compression spring 20, the compression spring 16 that pushes against the trigger-shoe 34 and the spacer 14 (not shown) inside of the bore 24, and the adjustable screw 18. The compression spring 20 is clicked into place to "lock" the adjustable screw 18.

FIG. 14 shows the adjustable screw 18 inserted into the bore 24. As shown, when the adjustable screw is first threaded into the bore, the compression spring 20 does not lock the adjustable screw 18 into place. For ideal stability, the adjustable screw 18 should be screwed in at least far enough so that the adjustable screw 18 does lock it into place, as shown in FIG. 15. In the example shown in the figures, the adjustable screw 18 has two slots (28 and 30) for receiving the compression spring 20. In this configuration, with every half turn of the adjustable screw 18, the compression spring 20 clicks into place in one of the two slots (28 or 30). In the alternative, the adjustable screw 18 could have one slot so that the compression spring 20 clicks into place every full turn, or three slots so that the compression spring 20 click into place every $\frac{1}{3}^{rd}$ of a turn, or four slots so that the compression spring 20 clicks into place every $\frac{1}{4}^{th}$ of a turn, etc. FIG. 16 shows the position of the compression spring when it is between clicks, and FIG. 17 shows a different "clicked in" position of the adjustable screw 18 than FIG. 15.

Figure 18:
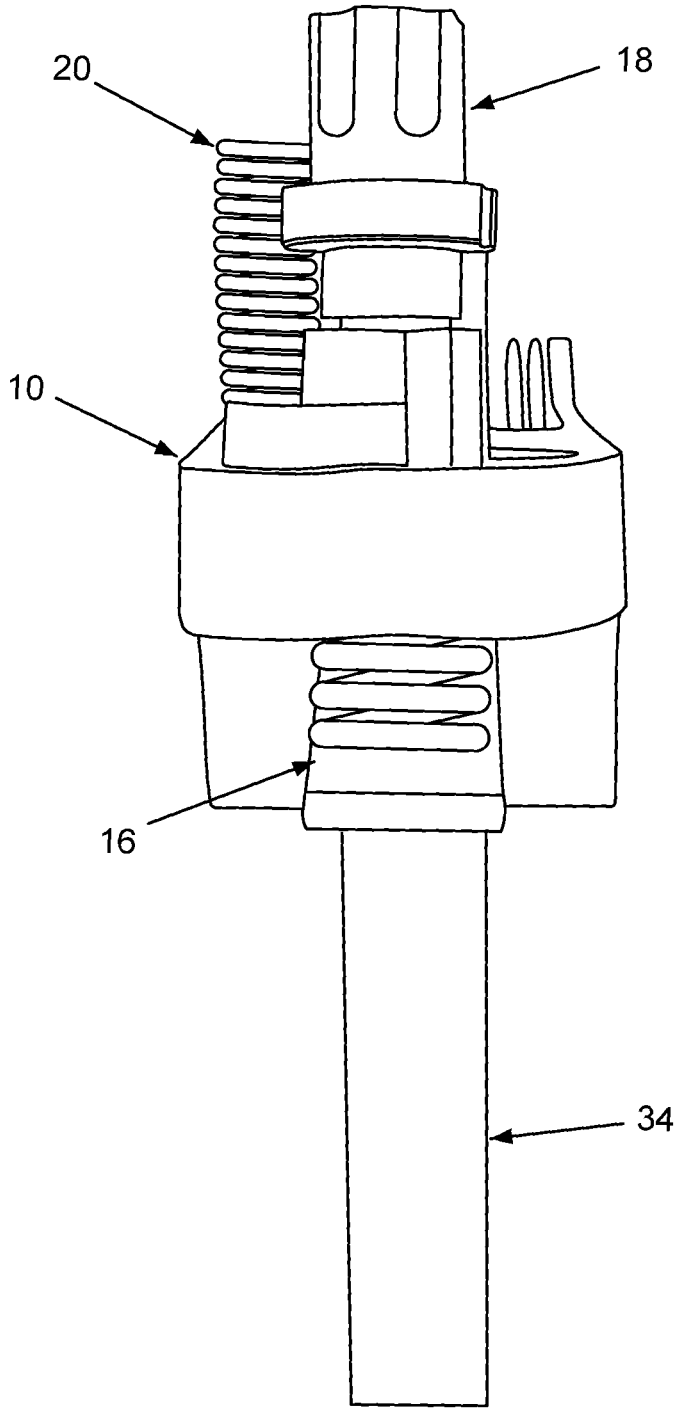
FIG. 18 is a front isometric view of the trigger assembly including the trigger housing 10, the trigger-shoe 34, the compression spring 20, the compression spring 16 that pushes against the trigger-shoe 34 and the spacer 14 (not shown) inside of the bore 24, and the adjustable screw 18.
Figure 19:
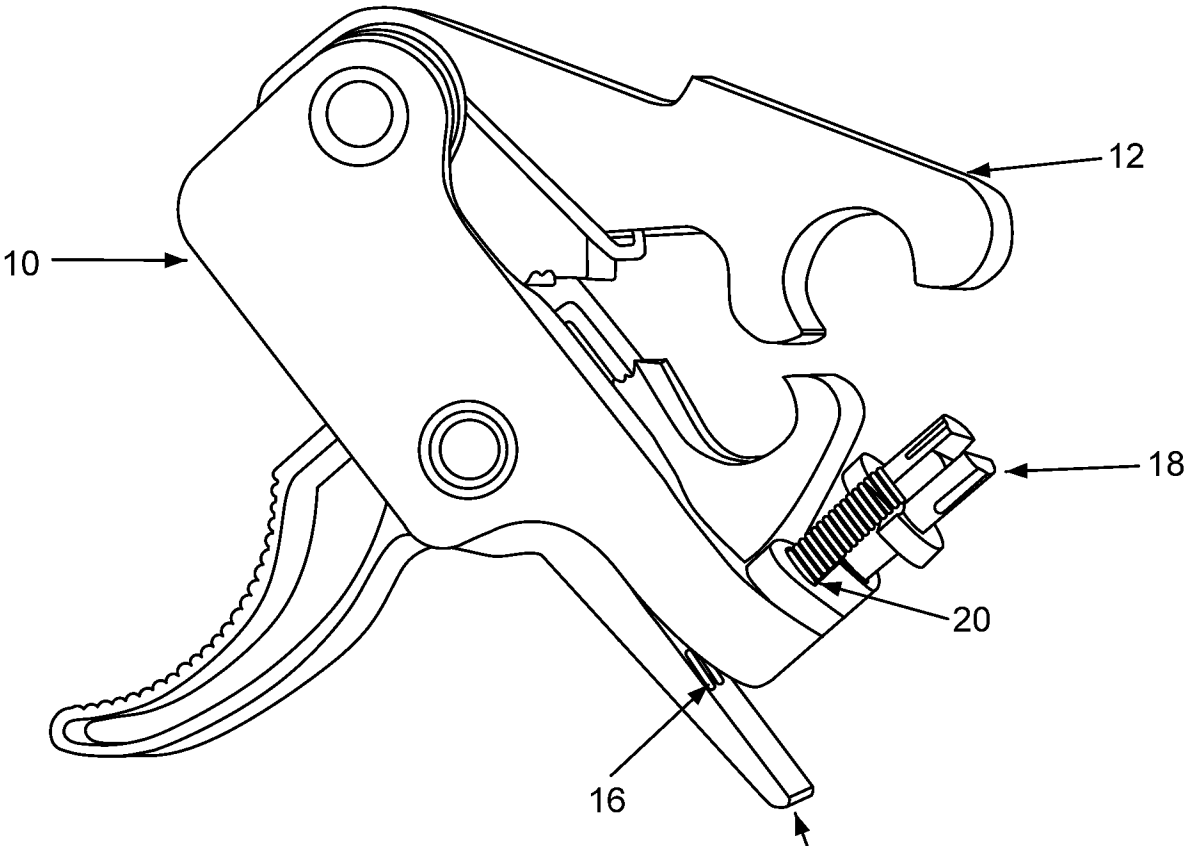
FIGS. 19 and 20 are isometric views of the trigger assembly.
Figure 20:
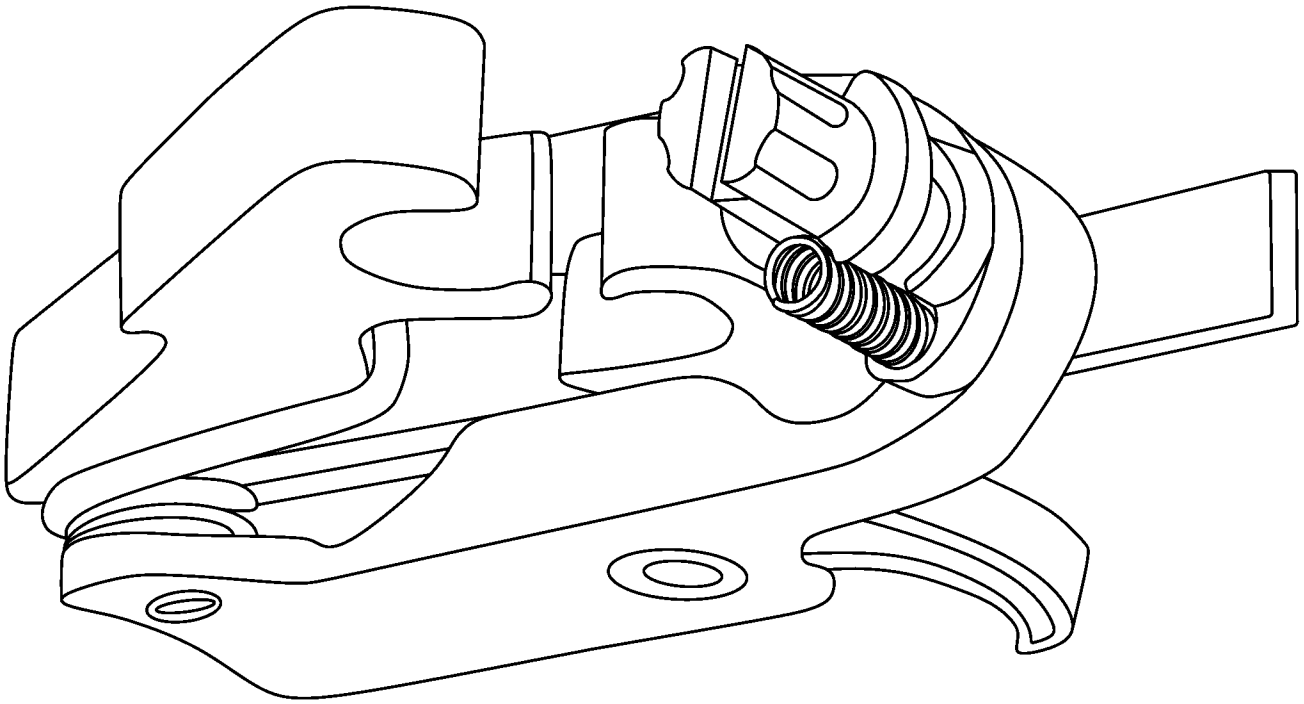
Figure 21:
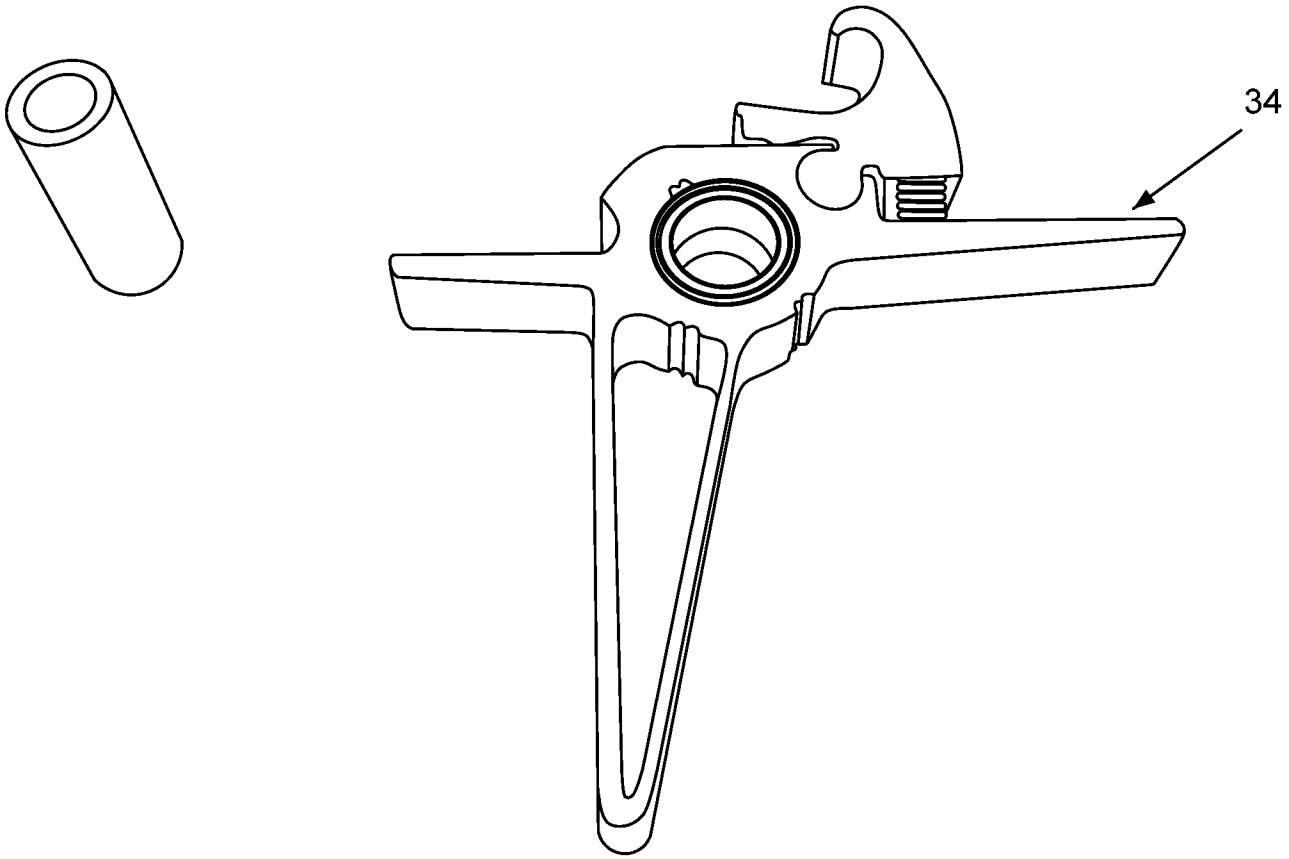
FIG. 21 shows the last "clicked in" position of the adjustable screw 18. Either the end of the threads on the threaded bore or the end of the threads on the adjustable (or both) will prevent further tightening of the adjustable screw 18.
Figure 22:
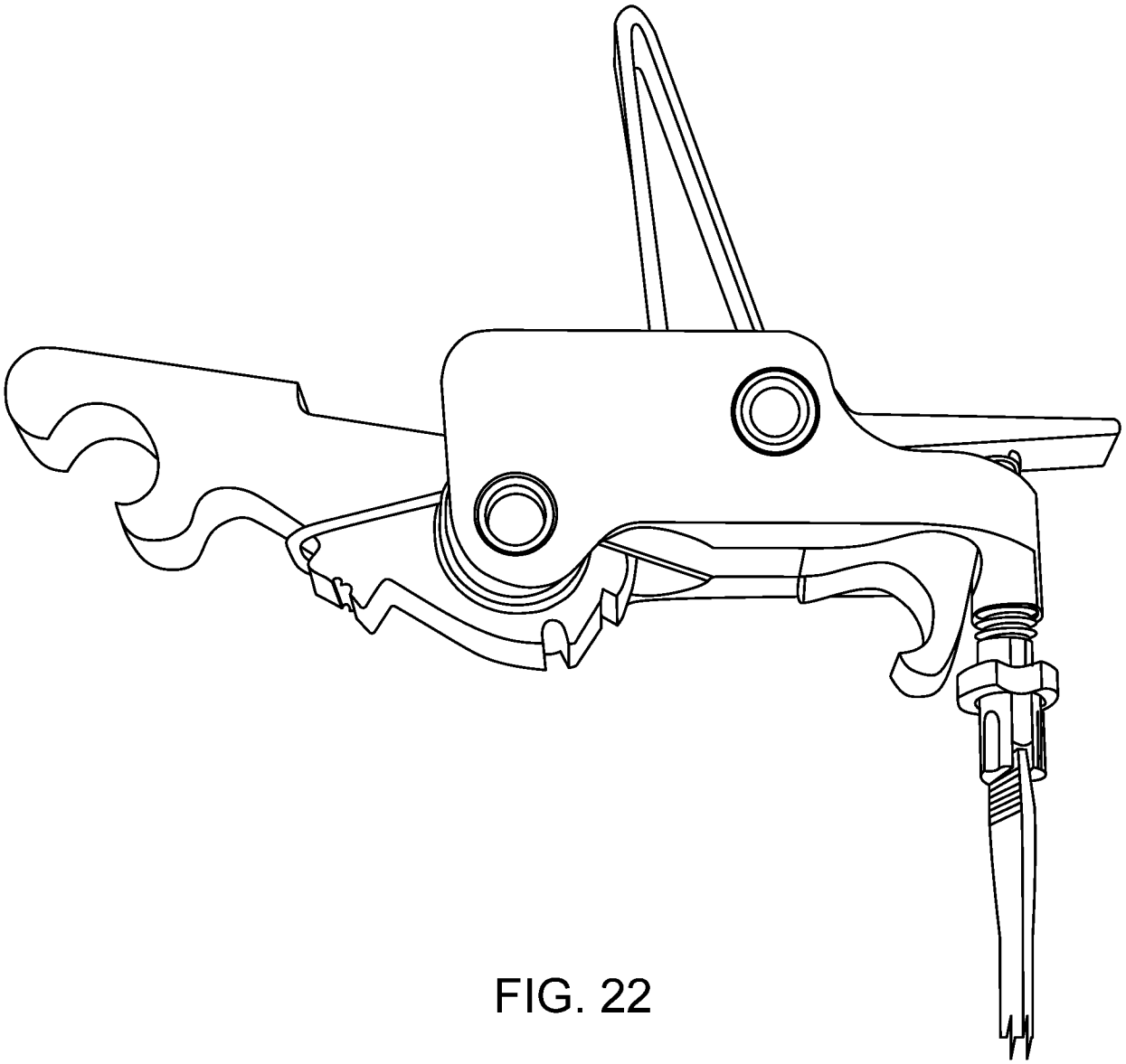
FIG. 22 shows a screwdriver inserted into the adjustable screw 18.

FIG. 18 shows the last "clicked in" position of the adjustable screw 18. Either the end of the threads on the threaded bore or the end of the threads on the adjustable (or both) will prevent further tightening of the adjustable screw 18.

The adjustable screw 18 also has a slot 32 so that it can be tightened with a screwdriver, coin, or other tool, if necessary.

In the foregoing Detailed Description, various features can be grouped together in several example embodiments for the purpose of streamlining the disclosure. This method of disclosure is not to be interpreted as reflecting an intention that any embodiment requires more features than are expressly recited in the corresponding claim. Rather, inventive subject matter may lie in less than all features of a single disclosed example embodiment. Thus, the present disclosure shall also be construed as implicitly disclosing any embodiment having any suitable set of one or more disclosed or claimed features (i.e., a set of features that are neither incompatible nor mutually exclusive) that appear in the present disclosure, including those sets that may not be explicitly disclosed herein.

The scope of the originally filed claims does not necessarily encompass the whole of the subject matter disclosed herein. The originally filed claims are hereby incorporated into the Detailed Description, with each claim standing on its own as a separate disclosed embodiment. The scope of subject matter encompassed by each claim shall be determined by the recitation of only that claim.

The conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. The words "comprising," "including," "having," and variants thereof, wherever they appear, shall be construed as open ended terminology, with the same meaning as if the phrase "at least" were appended after each instance thereof.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessary.

The use of the words "function," "means" or "step" in the Detailed Description or Description of the Drawings or claims is not intended to somehow indicate a desire to invoke the special provisions of 35 U.S.C. § 112,116, to define the invention. To the contrary, if the provisions of 35 U.S.C. § 112,116 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶6.

What is claimed:

1. A trigger assembly comprising:

a trigger housing including (1) a top side and a bottom side, (2) a threaded first bore in the top side, and (3) a second bore in the bottom side partially extending through the trigger housing to the first bore and located beneath the first bore, wherein the second bore is wider than the first bore;

a trigger shoe within the trigger housing configured to release a hammer in response to a trigger pull force to fire a weapon;

a first spring configured to be inserted in the second bore and in contact with the trigger shoe;

a second spring coupled to the trigger housing;

an adjustable screw including: (1) a threaded shaft configured to mate with the threaded first bore, and (2) one or more shaft slots, wherein (1) the adjustable screw is configured to push against the first spring when mated with the threaded first bore such that turning the adjustable screw adjusts the trigger pull force necessary for the trigger shoe to release the hammer, and 2) the second spring is configured to catch each of the one or more shaft slots to secure the adjustable screw in a plurality of positions within the threaded first bore.

2. The trigger assembly according to claim 1, wherein the adjustable screw contains a protrusion around the adjustable screw shaft, and the one or more shaft slots extend into the protrusion.

3. The trigger assembly according to claim 1 further comprising a spacer between the adjustable screw and the first spring.

4. The trigger assembly according to claim 3, wherein the spacer is attached to the first spring.

5. The trigger assembly according to claim 1 wherein the one or more shaft slots comprises two shaft slots.

6. The trigger assembly according to claim 1 wherein the one or more shaft slots comprises three shaft slots.

7. The trigger assembly according to claim 1 wherein the one or more shaft slots comprises four shaft slots.

8. The trigger assembly according to claim 1 wherein the adjustable screw includes a plurality of notches configured for hand-tightening the adjustable screw.

9. A method for adjusting the trigger pull force on a weapon including (1) a trigger housing with (a) a top side and a bottom side, (b) a threaded first bore in the top side, and (c) a second bore in the bottom side partially extending through the trigger housing to the first bore and located beneath the first bore, wherein the second bore is wider than the first bore; (2) a trigger shoe within the trigger housing configured to release a hammer in response to a trigger pull force to fire a weapon; (3) a first spring configured to be inserted in the second bore and in contact with the trigger shoe; (4) a second spring coupled to the trigger housing, and (5) an adjustable screw including: (a) a threaded shaft configured to mate with the threaded first bore, and (b) one or more shaft slots; the method comprising:

turning the adjustable screw in a first direction within the threaded first bore to push the adjustable screw against the first spring and adjust the trigger pull force necessary for the trigger shoe to release the hammer until the second spring catches one of the one or more shaft slots to secure the adjustable screw in a first position within the threaded first bore.

10. The method according to claim 9 further comprising turning the adjustable screw in a second direction within the threaded first bore to pull the adjustable screw away from the first spring and adjust the trigger pull force necessary for the trigger shoe to release the hammer until the second spring catches one of the one or more shaft slots to secure the adjustable screw in a second position within the threaded first bore.

11. The method according to claim 10, wherein the first direction is clockwise and the second direction is counterclockwise.

12. The method according to claim 9, wherein the first direction is clockwise.

13. The method according to claim 9, wherein the first direction is counterclockwise.

14. The method according to claim 9 further comprising turning the adjustable screw in the first direction within the threaded first bore again to push the adjustable screw against the first spring and adjust the trigger pull force necessary for the trigger shoe to release the hammer until the second spring catches a second of the one or more shaft slots to secure the adjustable screw in a second position within the threaded first bore.

15. The method according to claim 14 further comprising turning the adjustable screw in the first direction within the threaded first bore again to push the adjustable screw against the first spring and adjust the trigger pull force necessary for the trigger shoe to release the hammer until the second spring catches a third of the one or more shaft slots to secure the adjustable screw in a third position within the threaded first bore.

16. The method according to claim 15 further comprising turning the adjustable screw in the first direction within the threaded first bore again to push the adjustable screw against the first spring and adjust the trigger pull force necessary for the trigger shoe to release the hammer until the second spring catches a fourth of the one or more shaft slots to secure the adjustable screw in a fourth position within the threaded first bore.

17. The method according to claim 9 further comprising turning the adjustable screw with a screwdriver.

18. The method according to claim 9 further comprising turning the adjustable screw by hand.

19. The method according to claim 9 further comprising turning the adjustable screw with a star key.

20. The method according to claim 9 further comprising turning the adjustable screw with an allen key.

* * * * *